US007959242B2

(12) United States Patent
Del Castillo

(10) Patent No.: US 7,959,242 B2
(45) Date of Patent: Jun. 14, 2011

(54) POCKET DOOR CABINET AND SLIDE ASSEMBLY

(75) Inventor: Dennis Del Castillo, Alhambra, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 1570 days.

(21) Appl. No.: 10/453,849

(22) Filed: Jun. 2, 2003

(65) Prior Publication Data

US 2004/0239216 A1 Dec. 2, 2004

(51) Int. Cl.
*A47B 88/00* (2006.01)

(52) U.S. Cl. ..... 312/322; 312/319.1

(58) Field of Classification Search ..... 312/326–329, 312/139.1, 322–323, 319.1, 333, 334.7–334.8, 312/334.11; 49/254, 258, 260
See application file for complete search history.

(56) References Cited

U.S. PATENT DOCUMENTS

| | | | | | |
|---|---|---|---|---|---|
| 2,936,206 | A | * | 5/1960 | Wilmer et al. | 312/322 |
| 3,017,233 | A | * | 1/1962 | Gates | 312/322 |
| 4,974,912 | A | * | 12/1990 | Rask et al. | 312/322 |
| 4,976,502 | A | * | 12/1990 | Kelley et al. | 312/322 |
| 5,108,165 | A | * | 4/1992 | Rorke et al. | 312/322 |
| 5,131,449 | A | * | 7/1992 | Winn et al. | 312/322 |
| 5,395,165 | A | * | 3/1995 | Woerner | 312/110 |
| 6,282,770 | B1 | * | 9/2001 | Lyon | 312/322 |
| 6,994,410 | B2 | | 2/2006 | Hogan | |
| 2002/0011766 | A1 | * | 1/2002 | Kim et al. | 312/319.1 |
| 2004/0046488 | A1 | | 3/2004 | Hogan | |
| 2004/0100171 | A1 | * | 5/2004 | Brown | 312/322 |

FOREIGN PATENT DOCUMENTS

| | | | |
|---|---|---|---|
| DE | 2306206 | * | 8/1974 |
| JP | 02266080 | * | 10/1990 |

* cited by examiner

*Primary Examiner* — Hanh V Tran
(74) *Attorney, Agent, or Firm* — Christie, Parker & Hale, LLP

(57) ABSTRACT

A slidable structure for a pocket door cabinet. The slidable structure may be coupled to a false wall of the pocket door cabinet, with a door hinged to the slidable structure. In some aspects, the slidable structure includes a self-open mechanism to force the door to a fully extended position.

18 Claims, 10 Drawing Sheets

POCKET DOOR CABINET AND SLIDE ASSEMBLY

BACKGROUND OF THE INVENTION

The invention relates generally to cabinets and cabinet door assemblies, and more particularly to pocket door cabinets.

Cabinets are often used for storage of items. Cabinets allow for storage of items, generally out of view and often without the need for constructing built-in fixtures in houses, offices or other structures.

Often cabinets include a storage enclosure accessible by a door. The door may be a sliding door, which has an advantage of the door remaining within the footprint of the cabinet. A disadvantage of a sliding door, however, is that the door, or a part of the door, blocks easy access to a portion of the enclosure. The door may also be a hinged door, which has the advantage of providing more complete access to the enclosure and its contents, but has the disadvantage of extending beyond the footprint of the cabinet when the door is open.

One type of a cabinet which combines many of the advantages of a cabinet with a sliding door and a cabinet with a hinged door is a pocket door cabinet. In a pocket door cabinet the doors open in a hinged manner, allowing easy access to the contents of the enclosure. The door is also coupled to a slidable assembly such that the door, once open, may be moved into a hidden position within the cabinet itself. The door is usually slid into place against a side wall of the superstructure of the cabinet. In some instances, a false wall is provided within the cabinet so as to form a storage place, or pocket, for storage of the door.

A number of issues are raised in the design and construction of a pocket door cabinet. For example, a slidable assembly is generally mounted within the pocket door cabinet, with the door in some manner hinged to the slide assembly. Attempts by user to close the cabinet door prior to full extension of the door outside of the superstructure of the cabinet may result in damage to the door or the cabinet. As the door is generally made of wood, the damage is usually to the door as it hits the slidable structure, which is generally metal, prior to full extension away from the slidable structure in the cabinet. In addition, at times modification or replacement, or mere installation, of the slidable structure may be difficult due to the constrained volume of the pocket door area.

SUMMARY OF THE INVENTION

The present invention provides a pocket door cabinet and slide assembly. In one aspect, the invention provides an enclosure with a pocket door, comprising an enclosure formed of a top wall, a bottom wall, and side walls interconnecting the top wall and the bottom wall; a slidable structure mounted within the enclosure approximate a one of the side walls, the slidable structure translatable from approximate a front of the enclosure towards a rear of the enclosure; a door hingedly coupled to the slidable structure, the door being moveable, with the slidable structure approximate the front of the enclosure, from a closed position to an open position, the door being translatable with the slidable structure towards the rear of the enclosure with the door in the open position, the door being within the enclosure between the slidable structure and the one of the side wall when the slidable structure is translated towards the rear of the enclosure.

Another aspect of the invention provides a slidable structure for a pocket door cabinet, comprising a slide rail adapted to be coupled to a false wall of the cabinet; a slidable member coupled to the slide rail, the slidable member being translatable from a rear position on the slide rail to a forward position on the slide rail; and a self-open mechanism adapted to force the slide member to the forward position.

Another aspect of the invention provides a slidable structure for a pocket door cabinet, comprising a slide rail; means for coupling a false wall to a first side of the slide rail, the means for coupling being attachable to a bottom or top of a cabinet enclosure; a slidable member translatably coupled to the slide rail; and means for coupling a door to the slidable member.

Another aspect of the invention provides a slidable structure for a pocket door cabinet, comprising an upper slide rail with an upper slidable member translatably coupled to the upper slide rail; a lower slide rail with a lower slidable member translatably coupled to the lower slide rail, and a connecting member pivotally coupling the upper slidable member and the lower slidable member.

These and other aspects of the invention are more fully comprehended in view of the figures and discussion of this disclosure.

DETAILED DESCRIPTION

Figure 1:
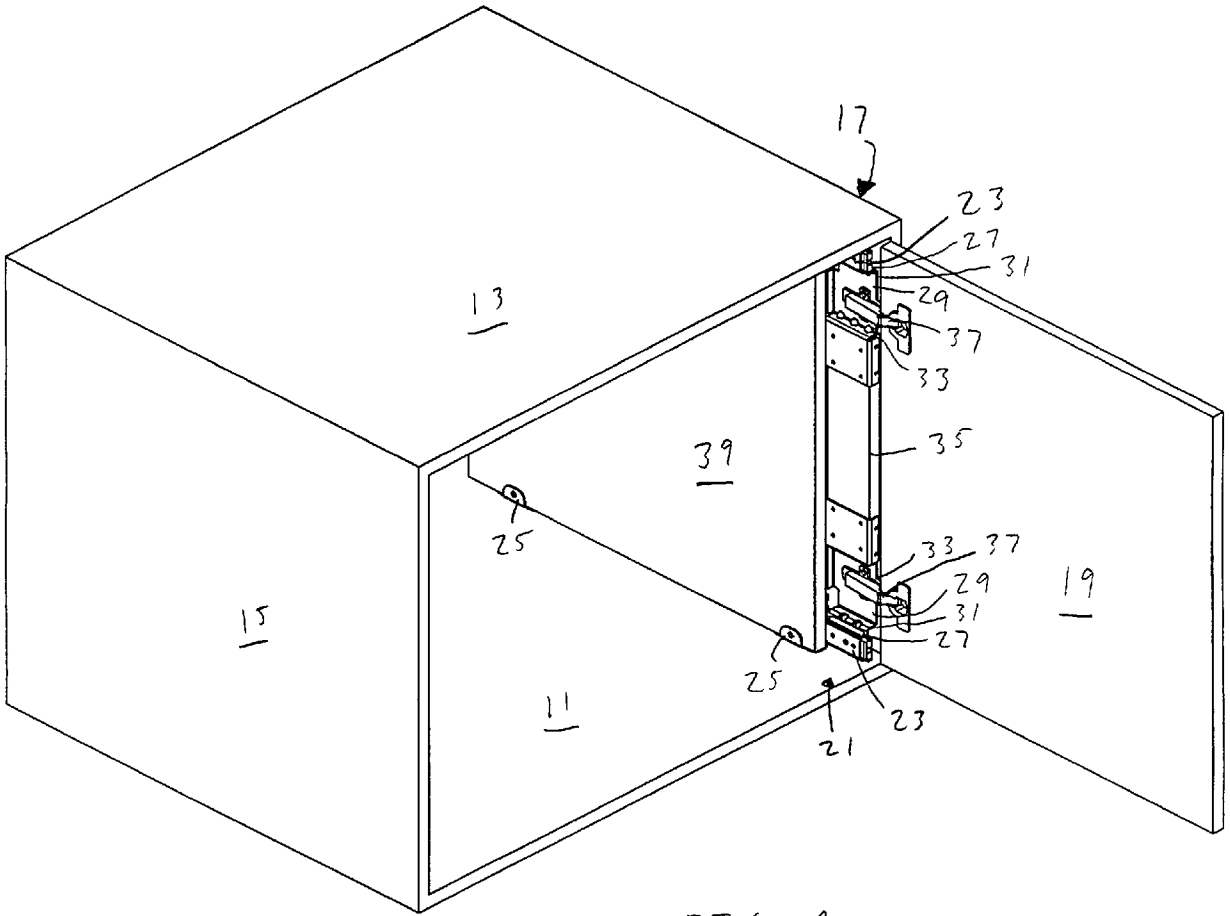
FIG. 1 illustrates a perspective view of a cabinet in accordance with aspects of the present invention.

FIG. 1 illustrates a perspective view of a pocket door cabinet in accordance with aspects of the invention. The cabinet includes a planar bottom 11 and a planar top 13, with sides of the bottom and top interconnected by side walls 15,17. The bottom, top, and side walls form a storage enclosure. Access to the storage enclosure, e.g. the inside of the cabinet, is provided by a door 19 at the front of the cabinet. As illustrated in FIG. 1 the door is hingedly coupled about one of the side walls. In other embodiments multiple doors are provided, with, for example, a door hingedly coupled to each of the side walls. When the door is in the closed position access to the interior of the cabinet is restricted. When the door is in the open position, as illustrated in FIG. 1, easy access to the interior of the cabinet is provided.

In the embodiment of FIG. 1, the door is not directly hinged to the side wall. Instead, the door is hinged to a slidable structure 21 coupled to the interior of the cabinet. The slidable structure includes slide rails 23 coupled to mounting brackets 25 attached to the top and bottom of the cabinet. The mounting brackets are slightly inset from the side wall, and couple the slide rails longitudinally from the front to the rear of the cabinet.

Sliding members 27 are slidably, or rollably, coupled to the slide rails. The sliding members may be coupled to the slide rails, for example, using ball bearings or roller bearings or the like. The sliding members, therefore, are adapted to slidably, or rollably, translate on the slide rails from the front to the rear of the cabinet.

Offset brackets 29 are mounted to the sliding members, with offset bracket extending up from a lower sliding member and another offset bracket extending down from an upper sliding member. The offset brackets include a jog 31 towards the side wall, such that leading tabs 33 of the offset brackets are approximate the side wall. A connecting member 35, which may be termed a follower, couples the two offset brackets. The connecting member couples the offset brackets, and therefore the sliding members, such that the sliding members move substantially in parallel and maintain substantially the same position with respect to one another as the sliding members slide on the slide rails.

The door is hinged to the offset brackets. As illustrated in FIG. 1, the door is hinged using European style hidden hinges 37, which remain out of view when the door is closed. A lower hinge is mounted to the side of the leading tab of the lower offset bracket facing away from the side wall. The lower hinge is also mounted to the rear of the door, close to one edge of the door. Similarly, an upper hinge is mounted to the side of the leading tab of the upper offset bracket facing away from the side wall and to the rear of the door, close to the edge of the door.

The mounting brackets are also used for mounting a false wall 39 within the interior of the cabinet. The false wall is parallel to and inset from the side wall, with the slidable structure 21 between the false wall and the side wall. The false wall provides a more well defined storage volume for the cabinet, with the slidable structure in a volume, or pocket, separated from the storage volume. In operation, and as will be discussed more fully with respect to FIG. 3, when the door is open the door may be conveniently translated, using the sliding structure, into the pocket formed by the false wall.

Figure 2:
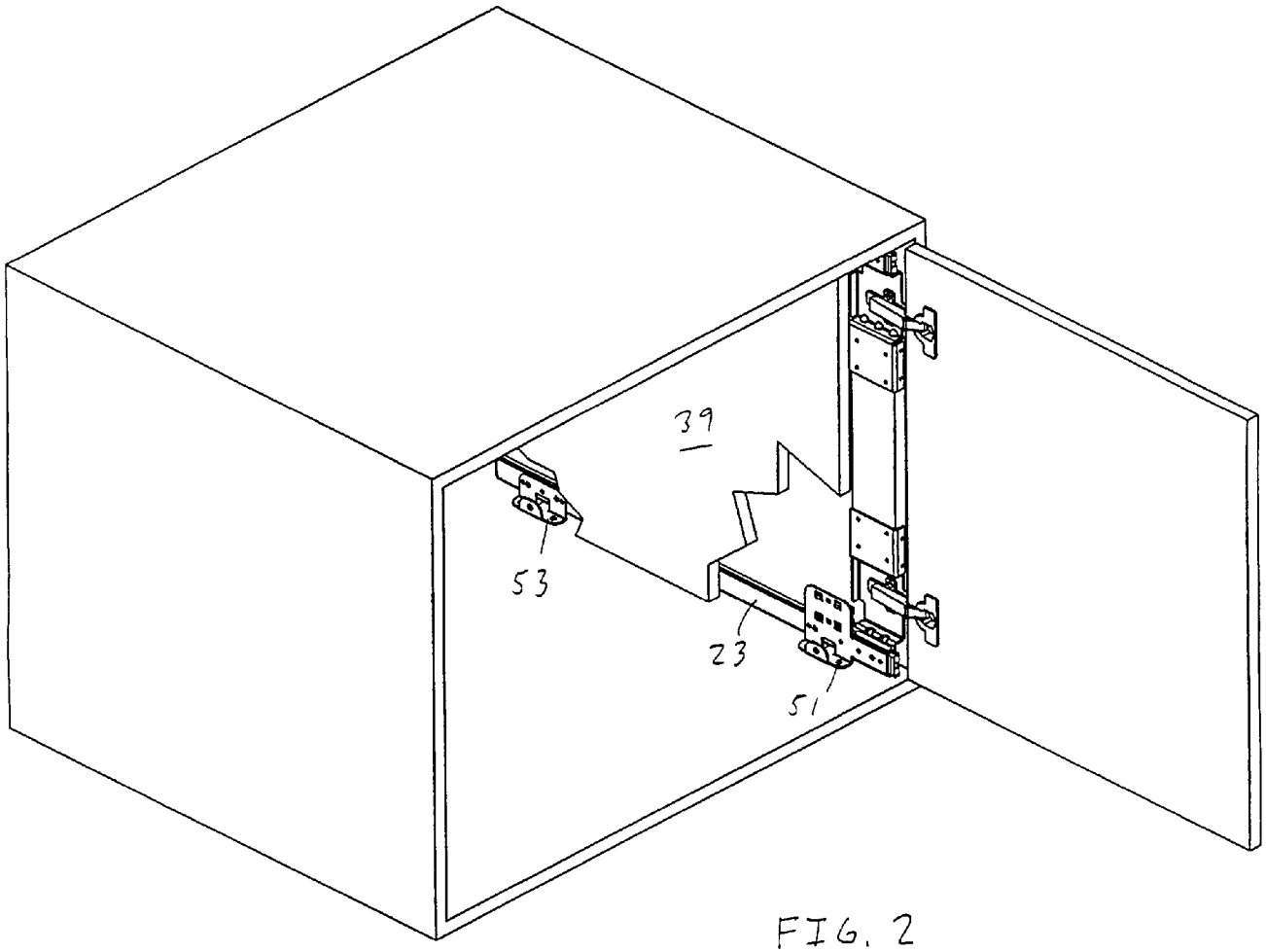
FIG. 2 illustrates a perspective view of a cabinet including cut-away portions of a false wall in accordance with aspects of the present invention.

FIG. 2 is a perspective view of the cabinet of FIG. 1 with portions of the false wall cut away. As may be seen in FIG. 2, the lower slide rail is coupled to a front U-bracket 51 and a rear U-bracket 53. The front and rear U-brackets are mounted to the bottom of the cabinet. Similarly, although not shown in FIG. 2, the upper slide rail is coupled to similar U-brackets mounted to the top of the cabinet.

More particularly, the lower slide rail is coupled to outside faces of the front and rear U-brackets. The channels of the U-brackets, or the width of the U-brackets, are dimensioned so as to receive the false wall. The false wall, therefore, is mounted within the cabinet by mounting the false wall to the U-brackets, with the slide rails on the outside faces of the U-brackets facing the side wall and within the pocket. Mounting the false wall to the U-brackets is beneficial in that removal of the false wall is more easily accomplished, providing easier access to the slidable structure.

Figure 3:
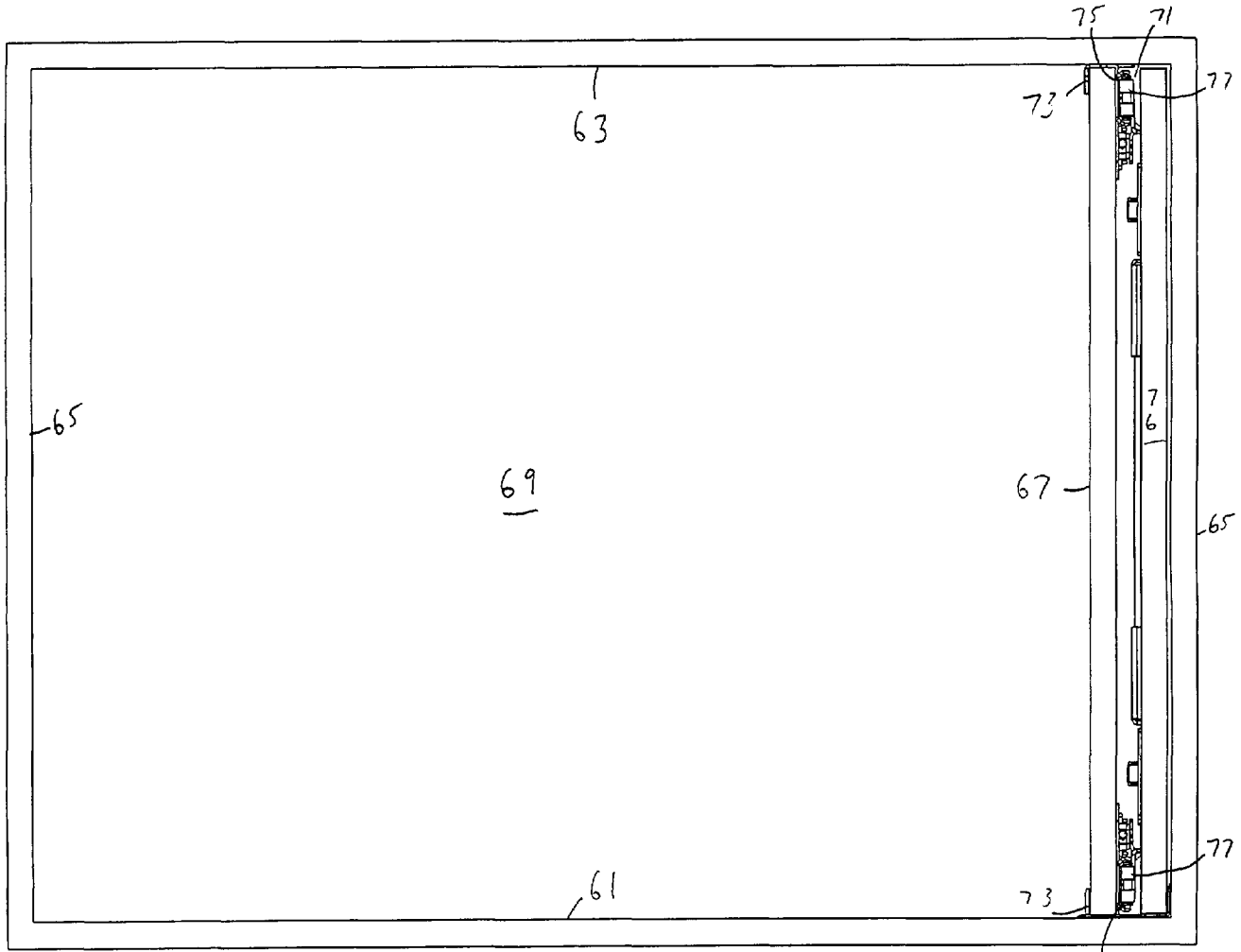
FIG. 3 illustrates a front view of a pocket door cabinet in accordance with aspects of the present invention.

FIG. 3 illustrates a front view of the cabinet with the door within the pocket. Thus, FIG. 3 illustrates a cabinet defined by a bottom 61 and a top 63, with the bottom and top interconnected on edges by side walls 65. A false wall 67 extends from the top to the bottom approximate one of the side walls. The other side wall, the false wall, and the top and bottom define a storage enclosure 69. A pocket 71 is formed between the false wall and the side wall approximate the false wall.

The false wall is mounted to the top and bottom of the cabinet using U-shaped brackets 73, with the false wall within the U of the U-shaped brackets. Slide rails 75 are affixed to pocket side faces of the U-shaped brackets. Sliding members 77 are coupled to the slide rails.

Returning briefly to FIG. 2, the sliding member is movable from a position on the slide rail approximate the front of the cabinet to a position on the slide rail approximate the rear of the cabinet. When the sliding members are approximately in the front of the cabinet, the cabinet door may be open and closed. With the sliding member approximate the rear of the cabinet, the cabinet door is maintained within the pocket area, as illustrated in FIG. 3

As shown in FIG. 3, a door 76 is between the sliding structure and the side wall. The sliding structure may be viewed as being mounted to the false wall, although for convenience the sliding structure is coupled to brackets used to mount the false wall. In effect, the sliding structure may be considered inside the cabinet door. Closing of the cabinet door, with the sliding structure towards but not entirely at the front of the cabinet may result in inadvertent contact between the door, generally wood, and the sliding structure, generally primarily metal. Such contact between wood and metal is more likely to damage, and possibly cause unsightly blemishes, to the wood. However, as the inside of the door faces the sliding structure, with the sliding structure inside the door, such contact generally may only damage the interior of the door, with the viewable exterior of the door remaining undamaged.

Figure 4:
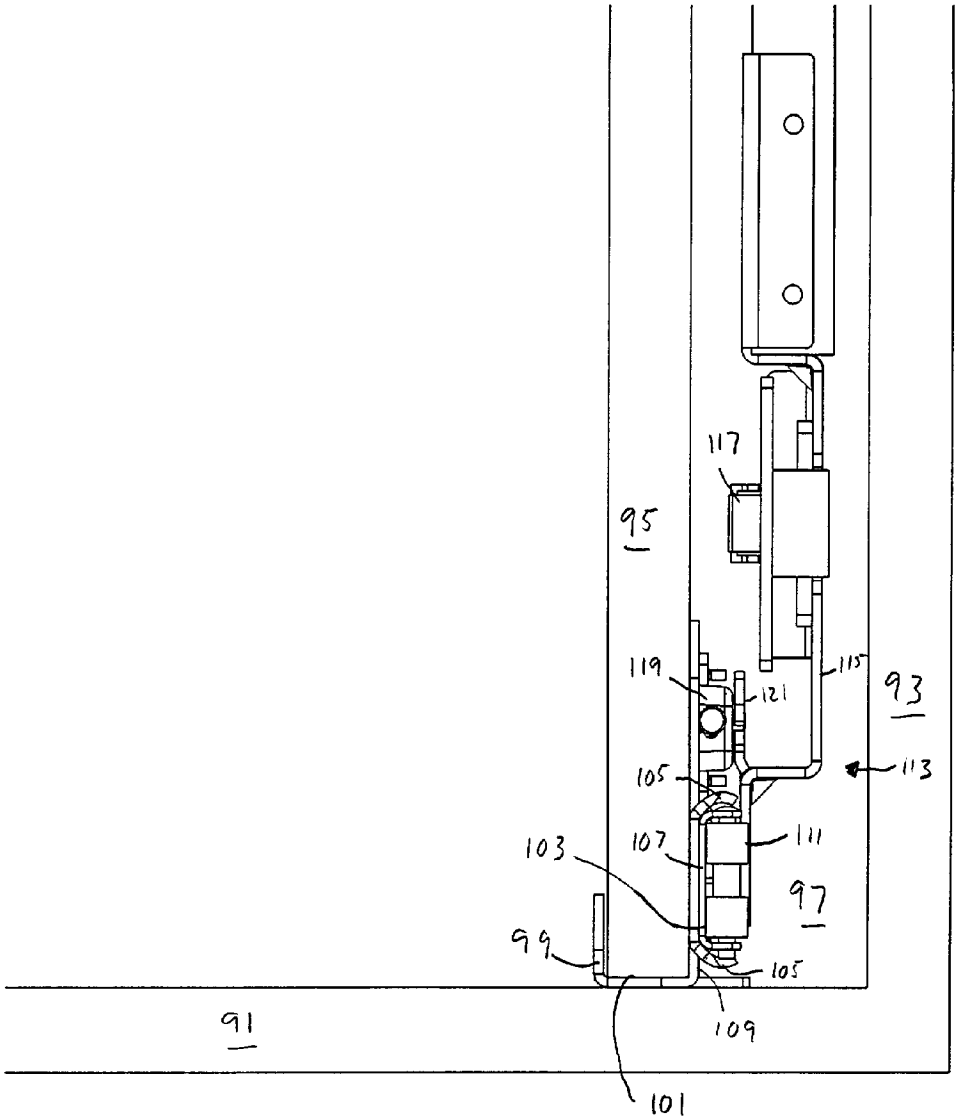
FIG. 4 illustrates a partial front view of a portion of the pocket door cabinet of FIG. 3.

FIG. 4 illustrates a partial front view of the cabinet with the door removed. As may be seen in FIG. 4, a cabinet includes a bottom wall 91 and a side wall 93. Inset from and parallel to the side wall is a false wall 95. A pocket 97 is defined by the false wall, the bottom wall, and the side wall.

The false wall is mounted to the bottom of the cabinet using a U-shaped bracket 99. The false wall is placed within a channel of the U-bracket 101. A slide rail 103 is mounted on the outside of the U-bracket within the pocket. The slide rail is substantially C-shaped, with arcuate raceways 105 interconnected by a web 107. The web is coupled to the outside face 109 of the U-bracket. A slidable member 111 is coupled to the slide rail, with, for example, ball bearings (not shown). An offset bracket 113 extends from the slidable member in an offset fashion, first towards the side wall and then upwards parallel to the side wall. The upwardly extending portion 115 of the offset bracket is coupled to a connecting member, which connects to a similar structure at the top (not shown in FIG. 4) of the cabinet. A hinge 117 is also mounted to the upwardly extending portion of the offset bracket. The hinge is adapted to hingedly couple a door.

The sliding structure of FIG. 4 also includes a self-open mechanism 119. The self-open mechanism is coupled to the side of the U-bracket facing the side wall. As illustrated in FIG. 4, the self-open mechanism is mounted above the slide rail. The offset bracket, mounted to the sliding member, includes flange. The flange extends upwards to a position where the flange is in line with a side of the self-open mechanism.

Figure 5:
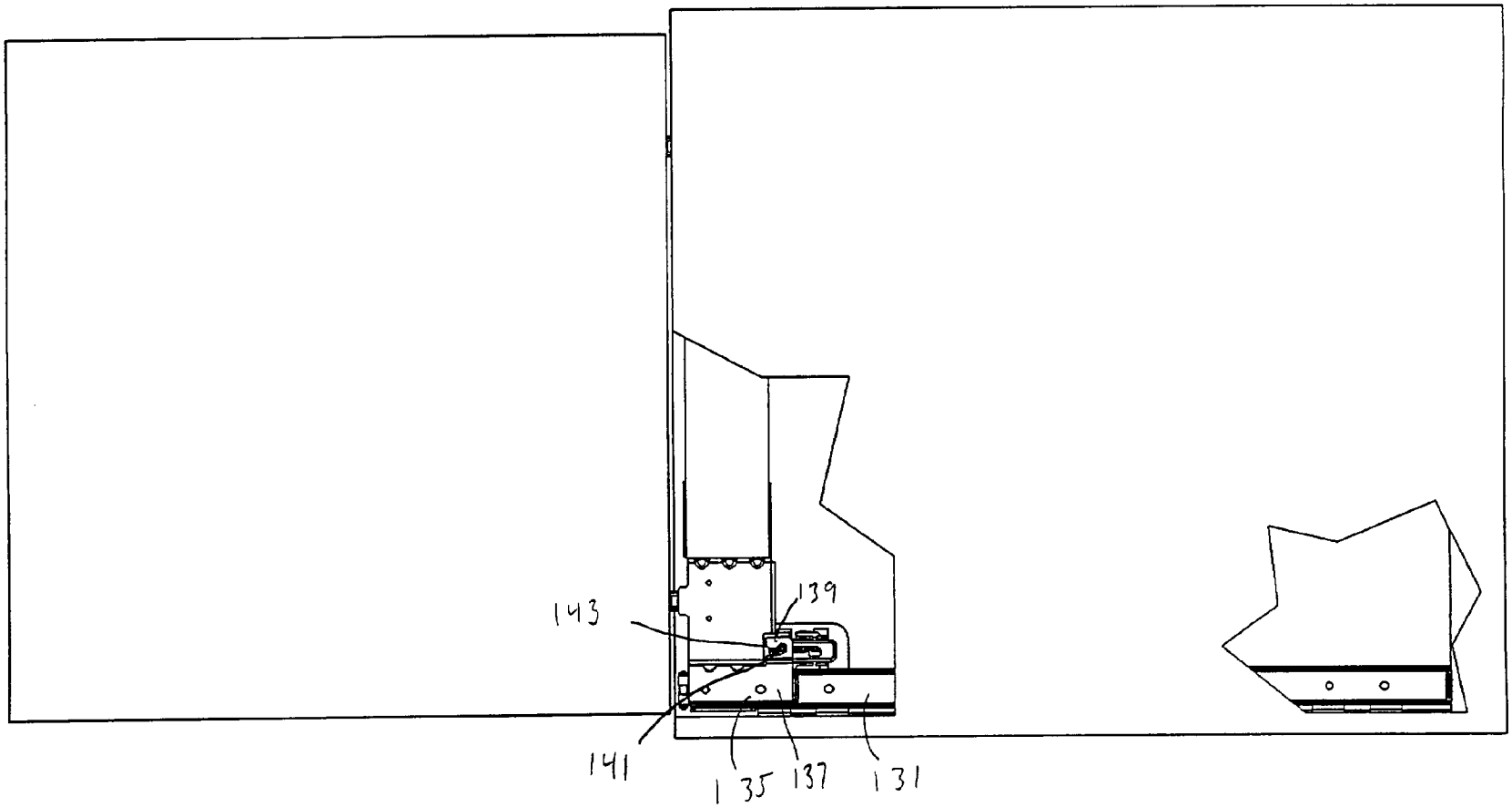
FIG. 5 illustrates a side view of a pocket door cabinet in accordance with aspects of the present invention including cut-away portions.

FIG. 5 illustrates a side view of a cabinet with portions of the side wall cut away. A lower slide 131 is visible through the cut away portions. As illustrated, a sliding member 135 is positioned approximate the front of the cabinet. A bracket 137 coupled to the sliding member includes a flange 139. The flange has a shaped cutout 141, which engages a pin 143 of a self-open mechanism 145.

Figure 6:
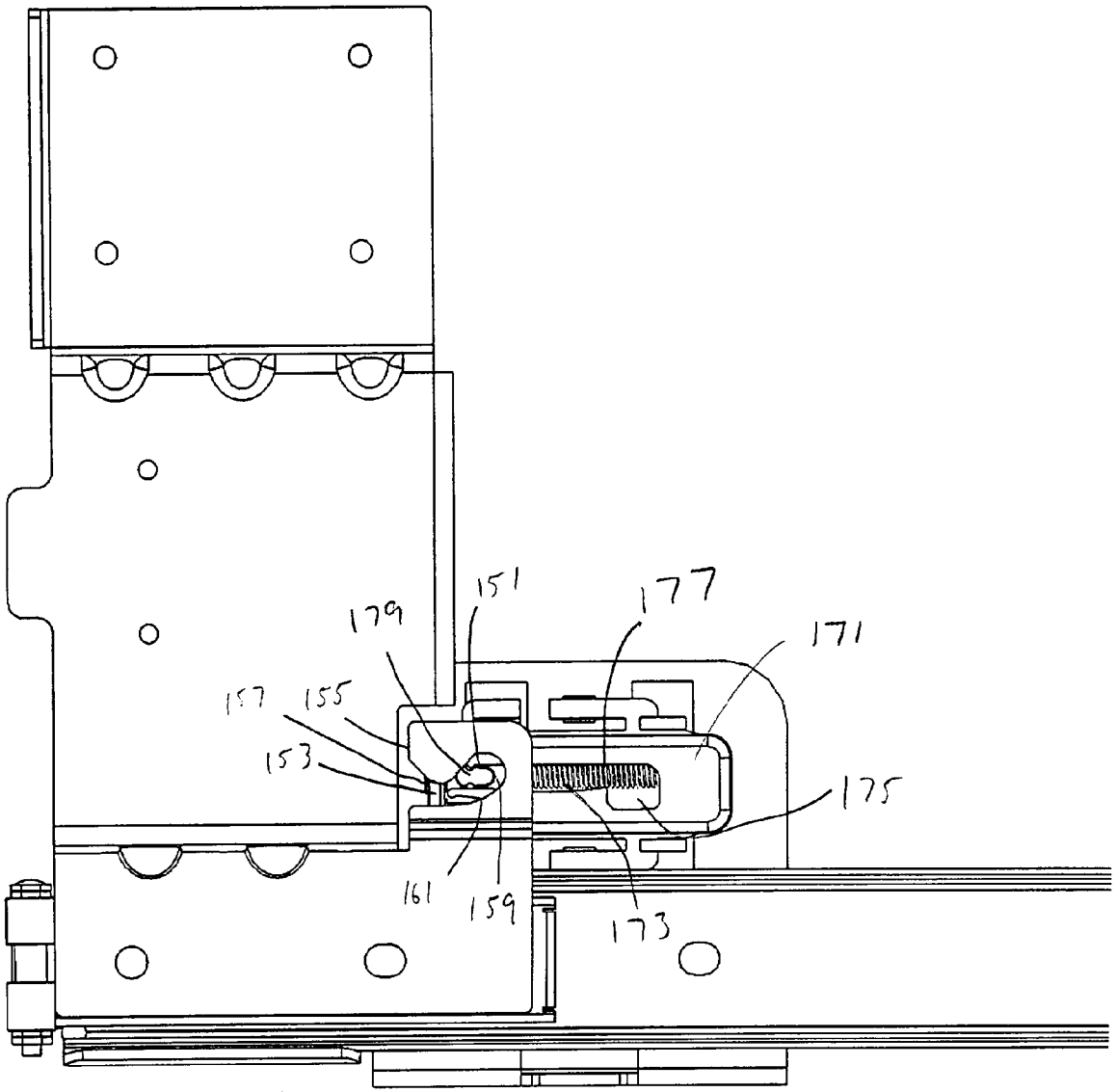
FIG. 6 illustrates portions of a slide assembly, including a self-close mechanism, in accordance with aspects of the present invention.

The flange and self-open mechanism may be more clearly seen in FIG. 6. The flange includes a shaped cutout 151. The shaped cutout includes a mouth 153 towards a front 155 of the flange, with a camming protrusion 157 on one side of the mouth. Past the camming protrusion the mouth opens into a reservoir, with the reservoir 159 more fully opening towards the side of the mouth including the camming protrusion, thereby forming a push ramp 161 opposite the camming protrusion.

The self-opening mechanism includes a body 171 with a substantially linear cutout 173, with a rear lock opening 175. A spring 177 is maintained within the body, with the spring biasing a pin 179 extending through the cutout towards the flange. In operation, when the sliding member, and therefore the flange, is at the rear of the cabinet the pin is held in the rear lock opening, with the spring compressed and biasing the pin towards a front surface of the rear lock opening. As the sliding member, and therefore the flange, moves forward, the push ramp contacts the pin and biases the pin out of the rear lock opening. With the pin free of the rear lock opening the spring biases the pin towards the front of the self-open mechanism, with the pin pressing against the camming protrusion. The force of the pin on the camming protrusion forces the flange, and therefore the sliding member and any door coupled to the sliding member, forward. Thus, the self-open mechanism assists in ensuring that the door is fully extended from the pocket, and the possibility of the door contacting the sliding structure, or the cabinet side wall, is reduced.

When the door is inserted into the pocket, the camming protrusion forces the pin back towards the rear lock opening. Once the pin reaches the rear of the cutout the camming protrusion forces the pin down into the rear lock opening. As the spring force is overcome to so move the door, the self-open mechanism also provides a detent out in inserting the door into the pocket.

Figure 7:
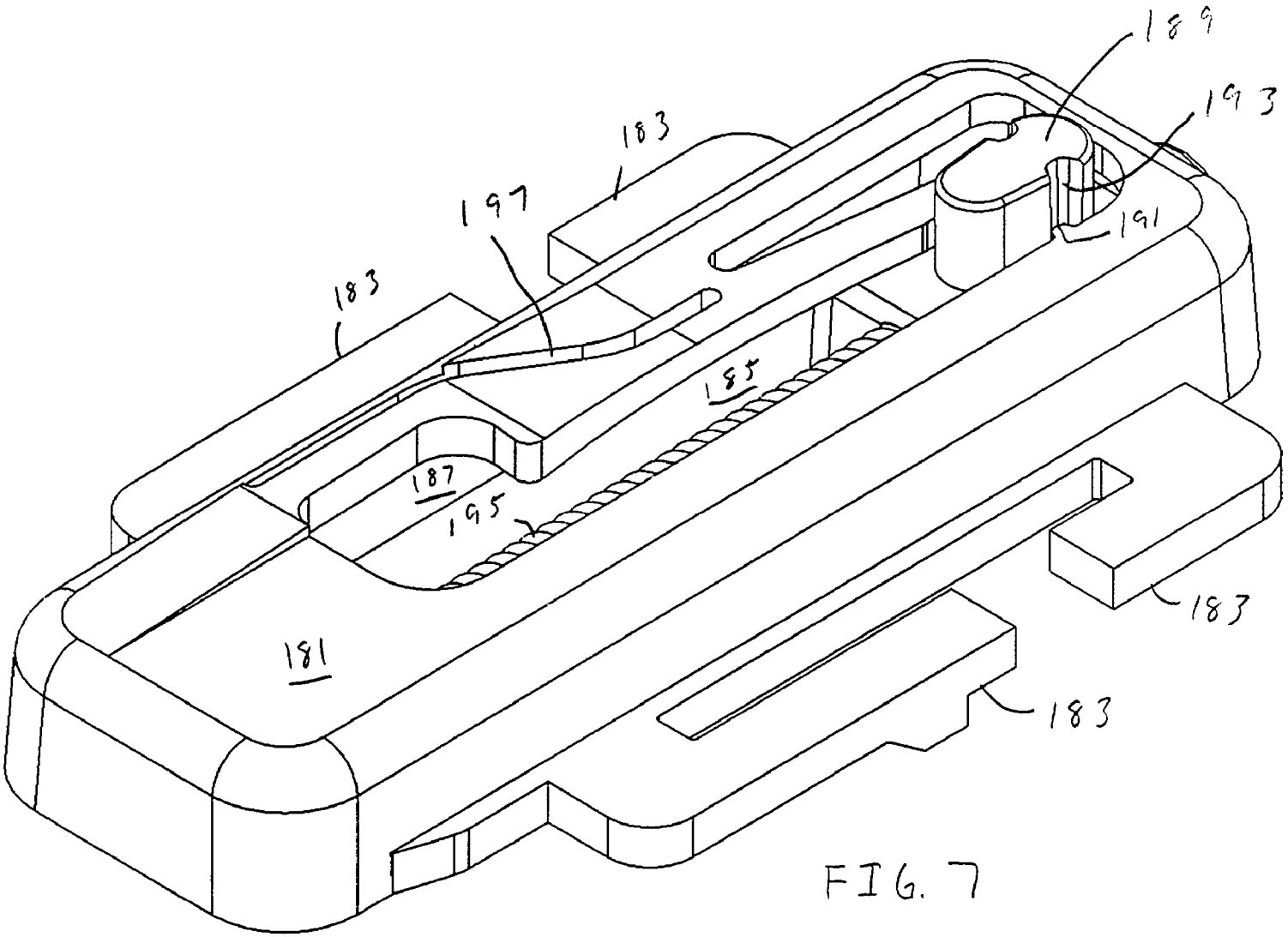
FIG. 7 illustrates a perspective view of a self-close mechanism in accordance with aspects of the present invention.
Figure 8:
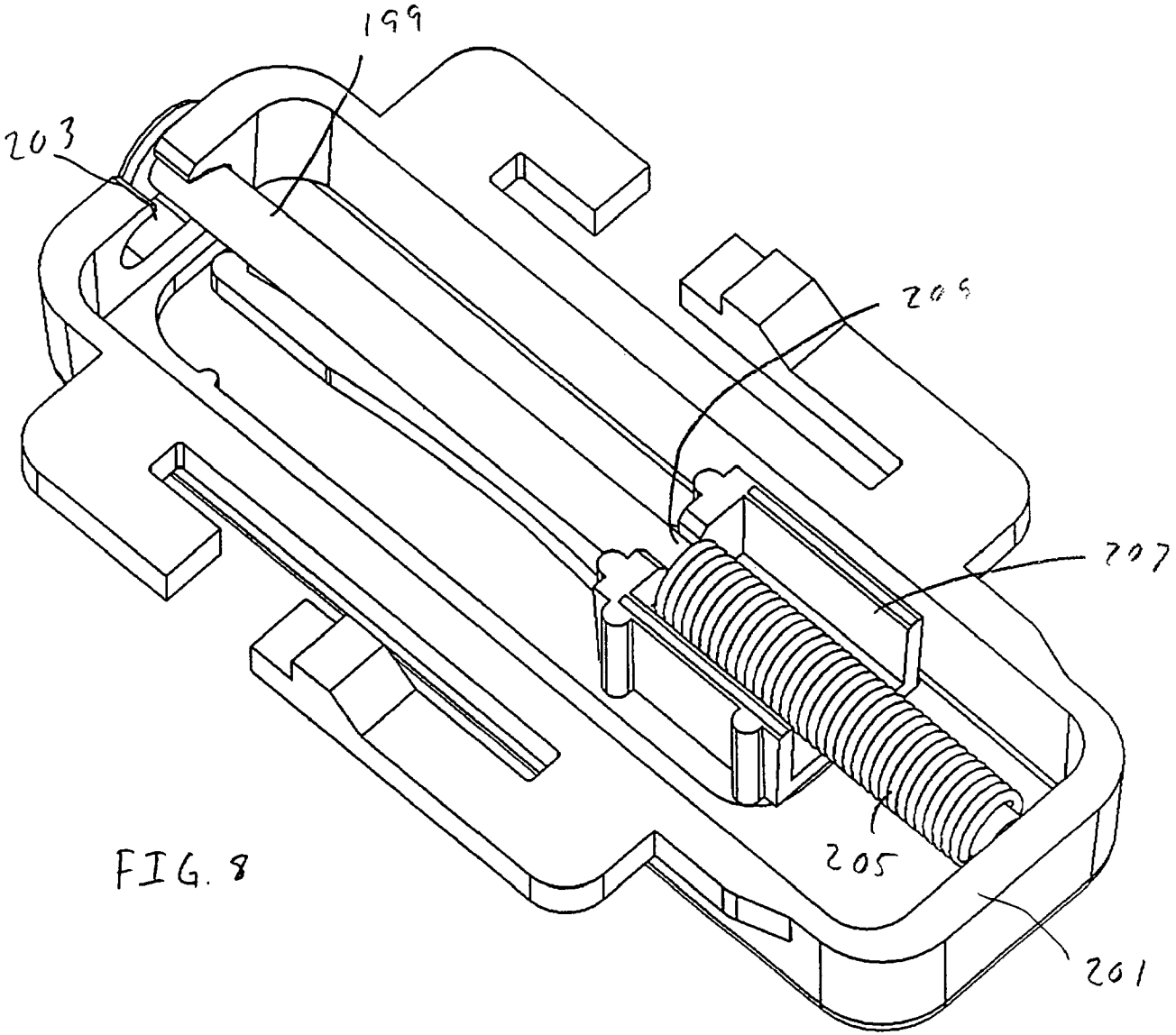
FIG. 8 illustrates a further perspective view of a self-close mechanism in accordance with aspects of the present invention.

Details of the self-open mechanism are shown in FIGS. 7 and 8. Further information regarding the self-open mechanism may also be found in U.S. patent application Ser. No. 09/846,765, filed Apr. 30, 2001, entitled Self-Closing Slide And Mechanism For A Self-Closing Slide, and U.S. patent application Ser. No. 10/224,664, filed Aug. 20, 2002, entitled Self-Closing Slide, both applications claiming the benefit of U.S. Provisional Patent Application No. 60/202,365, filed May 1, 2000, the disclosures of all being incorporated by reference in their entirety.

FIG. 7 illustrates a perspective view of a self-close mechanism. The self close mechanism includes a body 181 and mounting flanges 183 extending from the body. The body includes a linear cutout 185, with a notch 187 at one end of the linear cutout forming a rear lock opening. A pin 189 extends through the cutout. As illustrated the cutout includes a protrusion 191 on a side of the cutout away from the rear lock opening. The protrusion is dimensioned to engage a notch 193 on the pin. A spring 195 within the body biases the pin away from the rear lock opening.

The body also includes a cutaway slice 197 approximate the rear lock opening. The cutaway slice slices in front of the rear lock opening, so that when the pin is pressed against the front of the rear lock opening by the force of the spring, the slice compresses and dissipates some of the force exerted against the portion of the body forming a front face of the rear lock opening.

FIG. 8 illustrates a further perspective view of the self-open mechanism. FIG. 8, however, shows the interior of the body, which includes a post 199 extending from a rear 201 of the body through an aperture 203 at the front of the body. A cylindrical spring 205 is mounted on the post. The spring is illustrated in a compressed position, with a forward edge of the spring compressed by a compression shoe 207. The compression shoe includes a notch 209, through which passes the post. The pin (shown in FIG. 7) is attached to the shoe, and in most embodiments is unitarily formed with the shoe.

The aperture at the front of the body is in the form of a slot. The pin is able to move within the slot, thereby allowing some translation of the pin, for example when the shoe is translated perpendicular to the general line of the post when the pin is forced into the rear lock opening.

Figure 9:
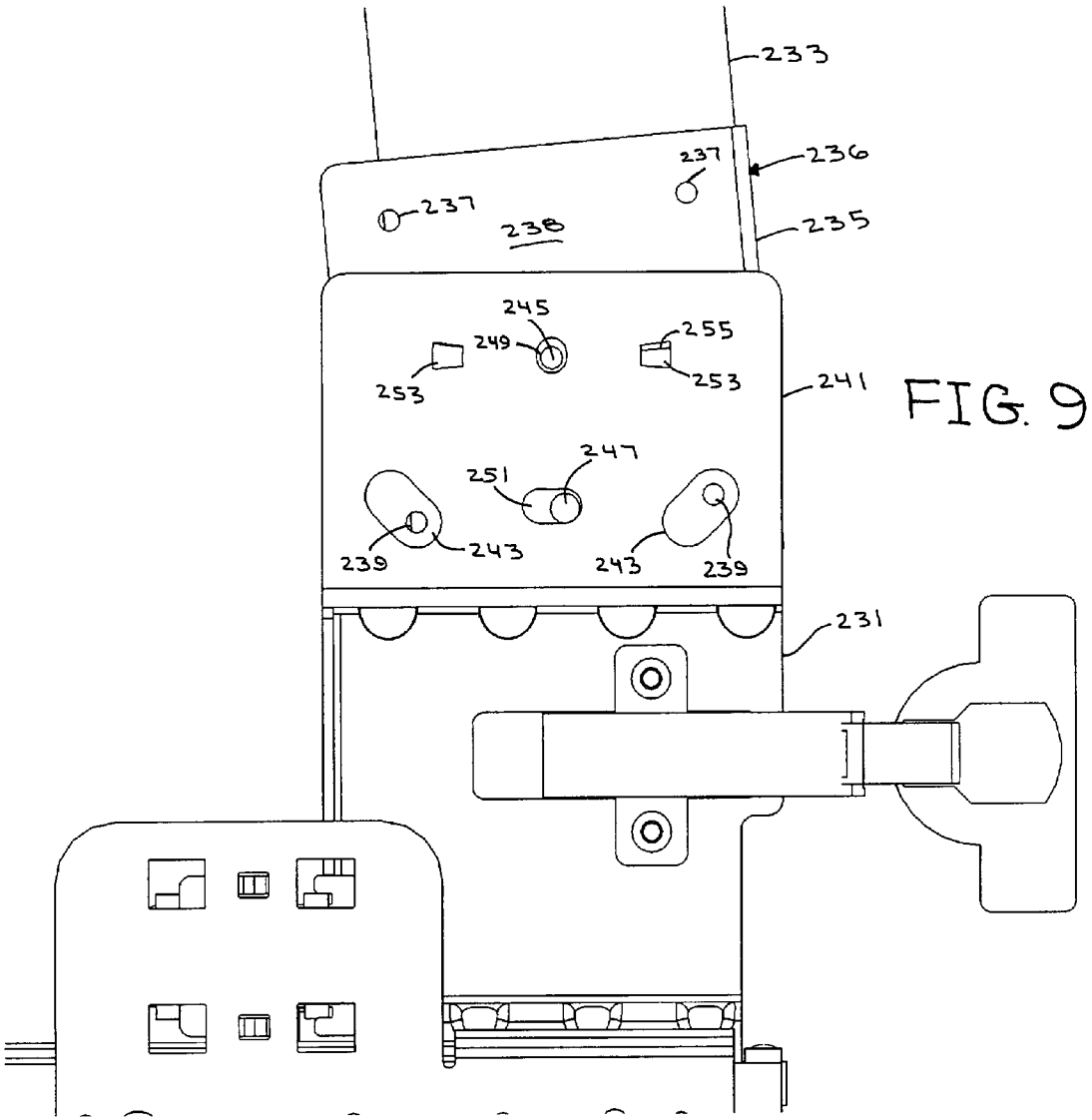
FIG. 9 illustrates a planar view of an embodiment in which a connecting member is coupled to an offset bracket using a pivoting attachment.

FIG. 9 shows a connecting member 233 coupled to an offset bracket 231. The connecting member is coupled to the offset bracket using a pivoting attachment 235. The pivoting attachment includes a face plate 238 with a flange 236 along one side of the face plate.

The connecting member is placed against the face plate, with the flange along an edge of the connecting member. The face plate includes upper screw holes 237 and lower screw holes 239. The upper screw holes are approximate an upper end of the face plate, and the lower screw holes are approximate a lower end of the face plate. The upper screw holes and the lower screw holes are adapted to receive a screw or the like with the connecting member positioned against the face plate, screws may be passed through the upper screw holes and the lower screw holes and into the connecting member so as to securely hold the connecting member against the face plate.

The face plate is juxtaposed against a receiving plate 241 of the offset bracket. The receiving plate includes a pivot aperture 249. The pivot aperture is approximate an upper portion of the receiving plate, and midway the length of the receiving plate. The pivot aperture receives a stud 245 extending from the face plate. In-some embodiments the stud is a rivet, for example a shoulder rivet. The face plate, which is part of the pivoting attachment, is therefore able to pivot about the stud.

A further stud 247 protrudes through a semi-cylindrical cutout 251 in the receiving plate. The semi-cylindrical cutout is substantially below the pivot aperture, and as the pivoting attachment is pivoted about the stud in the pivot aperture, the further stud moves within the cylindrical cutout.

The further stud is threaded to allow for a nut, such as a wing nut or a lock nut, to be screwed onto the further stud. Thus, the pivoting attachment may be pivoted about the stud in the pivot aperture, with the position of the pivoting attachment, and therefore the connecting member, fixed in a desired position by tightening the wing nut.

Fine adjustment of the position of the pivoting attachment may also be provided through the use of a blade screwdriver or the like being inserted through fine adjustment cutouts 253 and into blade holes 255. The fine adjustment cutouts are in the receiving plate of the offset bracket, and the blade holes are on the face plate of the pivoting attachment.

Figure 10:
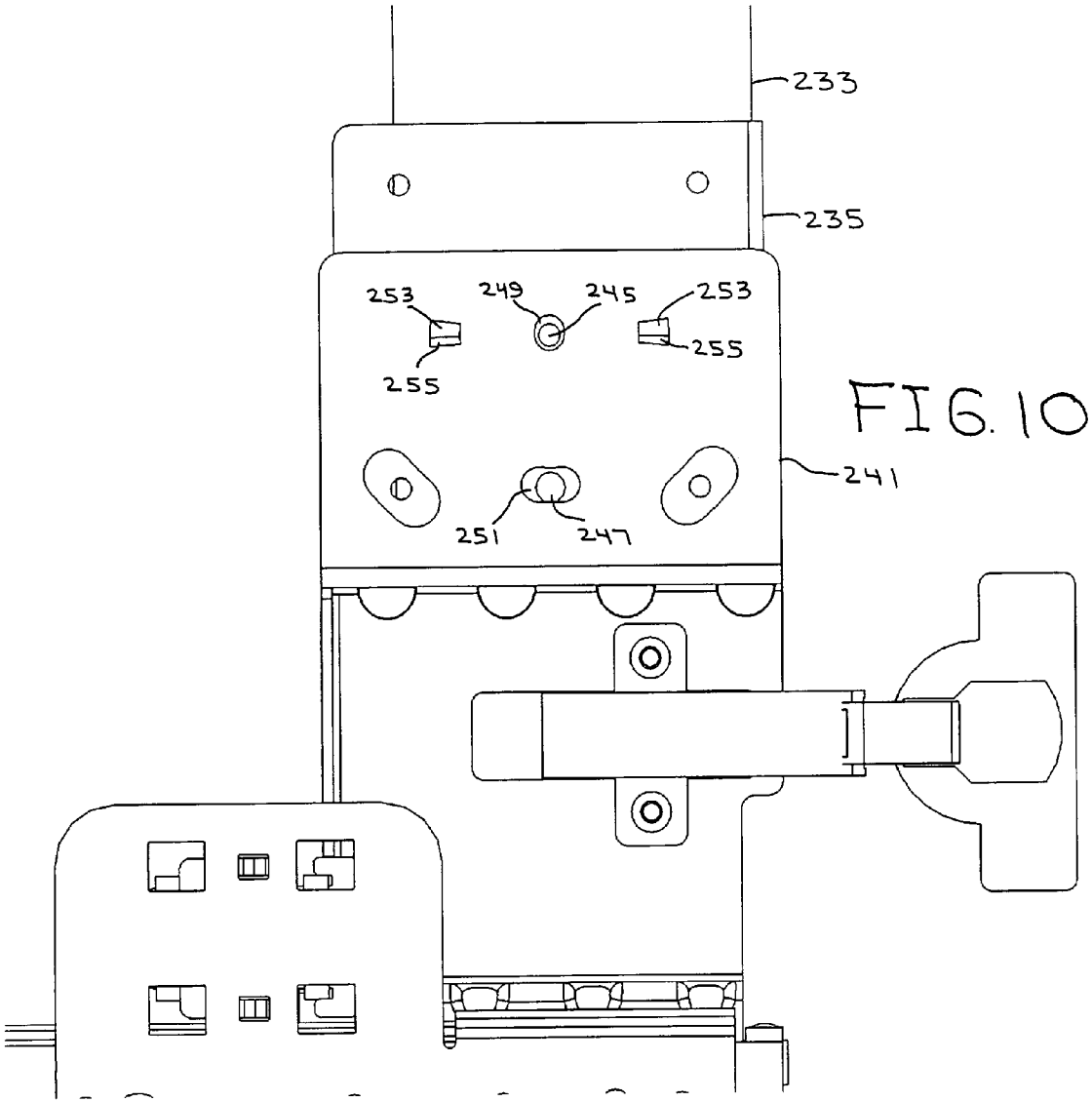
FIG. 10 illustrates a further planar view of the embodiment of FIG. 9.

As may be seen in FIG. 10, blade holes 255 are on opposing sides of stud 245 of the face plate. With the face plate juxtaposed against the receiving plate, and the stud 249 in the pivoting aperture 245, the blade holes 255 are accessible through the blade cutouts 253. Application of pressure against the side of the blade holes in the side of the blade cutouts allows for fine rotation, or pivoting of the pivoting attachment, and therefore the coupling member, during installation.

Returning to FIG. 9, the receiving plate also includes link shaped cutouts 243 positioned such that the lower screw holes are visible through the cutouts when the stud is in the pivoting aperture. The cutouts allow access to the lower screw holes as the connecting member and pivoting attachment are pivoted.

once the connecting member is positioned as desired, the screws in the lower screw holes, along with washers as desired, may be securely tightened such that the screw head, or washers as appropriate, are tightly set against the receiving plate, holding the pivoting attachment in position.

The pivoting attachment is beneficial in many ways. For example, discrepancies or tolerances in positioning various items of the pocket door cabinet, some related to the slide assembly and some generally, may result in misalignment of the cabinet door. A misadjustment of the cabinet door may be compensated for by adjusting an angle of the connecting member, thereby the relative position of the hinges coupling the cabinet door to the slidable assembly. In addition, at times the weight of the cabinet door itself may cause some relative movement of portions of the slidable assembly. Such movement may be compensated for through adjustment of the connecting member as previously described. In addition, the slidable assemblies may be effectively pre-loaded through use of the pivoting attachment.

Although the invention has been described with respect to certain embodiments, it should be recognized that the present invention includes the claims and their equivalents supported by the disclosure.

What is claimed is:

1. An enclosure with a pocket door, comprising:

a top wall, a bottom wall, and side walls interconnecting the top wall and the bottom wall;

a slidable structure directly attached by a bracket to at least one of the top wall or bottom wall and within the enclosure approximate one of the side walls, the slidable structure translatable from approximate a front of the enclosure towards a rear of the enclosure; and a door hingedly coupled to the slidable structure, the door being moveable, with the slidable structure approximate the front of the enclosure, from a closed position to an open position, the door being translatable with the slidable structure towards the rear of the enclosure with the door in the open position, the door being within the enclosure between the slidable structure and the one of the side walls when the slidable structure is translated towards the rear of the enclosure.

2. The enclosure with a pocket door of claim 1 further comprising a false wall inset from and parallel to the side wall approximate the slidable structure, the false wall and the one of the side walls defining sides of a pocket, the false wall being coupled to the top wall and the bottom wall.

3. The enclosure with a pocket door of claim 2 wherein the slidable structure is within the pocket.

4. The enclosure with a pocket door of claim 3 further comprising brackets mounted to the top wall and the bottom wall, the false wall being mounted to the brackets.

5. The enclosure with a pocket door of claim 1 further comprising means for forcing the slidable structure to a position approximate the front of the enclosure.

6. The enclosure with a pocket door of claim 1 wherein the slidable structure, comprises:

a slide rail;

a slidable member coupled to the slide rail, the slidable member being translatable from a rear position on the slide rail to a forward position on the slide rail; and a self-open mechanism approximate a forward position of the slide rail, the self-open mechanism configured to force the slidable member to the forward position when the slidable member is approximate the forward position on the slide rail.

7. The enclosure with a pocket door of claim 6 wherein the self-open mechanism comprises a spring approximate the forward position on the slide rail.

8. The enclosure with a pocket door of claim 7 wherein the spring is coupled to a pin.

9. The enclosure with a pocket door of claim 8 wherein the slidable member includes a camming protrusion, the camming protrusion having a travel path that brings the camming protrusion into contact with the pin.

10. The enclosure with a pocket door of claim 9 wherein the pin is translatable from a forward position to a second locked position, the spring biasing the pin towards the forward position.

11. The enclosure with a pocket door of claim 10 wherein moving the camming protrusion in a reanvard direction drives the pin into the lock position.

12. The enclosure with a pocket door of claim 11 further comprising a push ramp coupled to the slidable member, the push ramp positioned so that its travel path pushes the pin from the lock position as the slidable member moves forward.

13. A slidable structure for a pocket door cabinet, comprising:

a slide rail;

means for directly attaching a false wall to a bottom wall of a cabinet enclosure and for coupling the slide rail to the bottom wall of the cabinet enclosure;

a slidable member translatably coupled to the slide rail; and means for coupling a door to the slidable member.

14. A slidable structure for a pocket door cabinet, comprising:

an upper slide rail with an upper slidable member translatably coupled to the upper slide rail;

a lower slide rail with a lower slidable member translatably coupled to the lower slide rail; and a connecting member coupling the upper slidable member and the lower slidable member, the connecting member pivotally connected to the upper slidable member and pivotally connected to the lower slidable member.

15. The slidable structure for a pocket door cabinet of claim 14 wherein the lower slidable member includes a bracket having a pivot hole, wherein a stud associated with the connecting member passes through the pivot hole, with the stud and pivot hole forming a pivot point.

16. The slidable structure for a pocket door cabinet of claim 14 wherein the connecting member is pivotally coupled to the lower slide member by means for pivotally coupling the connecting member and the lower slide member.

17. A slidable structure for a pocket door cabinet, comprising:

an upper slide rail with an upper slidable member translatably coupled to the upper slide rail;

a lower slide rail with a lower slidable member translatably coupled to the lower slide rail; and a connecting member coupling the upper slidable member and the lower slidable member;

wherein the lower slidable member includes a bracket having a pivot hole, wherein a stud associated with the connecting member passes through the pivot hole, with the stud and pivot hole forming a pivot point; and wherein the bracket further includes a cutout, with a further stud associated with the connecting member moveable within the cutout.

18. The slidable structure for a pocket door cabinet of claim 17 further comprising further cutouts in the bracket and blade holes associated with the connecting member accessible through the further cutouts.

* * * * *

UNITED STATES PATENT AND TRADEMARK OFFICE

CERTIFICATE OF CORRECTION

PATENT NO. : 7,959,242 B2
APPLICATION NO. : 10/453849
DATED : June 14, 2011
INVENTOR(S) : Dennis Del Castillo It is certified that error appears in the above-identified patent and that said Letters Patent is hereby corrected as shown below:

In the Claims

Column 8, Claim 11, line 15 Delete "reanvard"
Insert -- rearward --

Signed and Sealed this
Twenty-ninth Day of November, 2011

David J. Kappos

David J. Kappos
*Director of the United States Patent and Trademark Office*